US005452549A

United States Patent [19]

Medeot et al.

[11] Patent Number: 5,452,549

[45] Date of Patent: Sep. 26, 1995

[54] LOAD DISSIPATING AND LIMITING DEVICE FOR APPLICATION IN CIVIL AND INDUSTRIAL WORKS HAVING A HIGH STRENGTH AGAINST SEISMIC EFFECTS

[76] Inventors: Renzo Medeot; Samuele Infanti, both of Via Scapacchio, 41, 35030 Selvazzano Dentro (Padova), Italy

[21] Appl. No.: 218,754

[22] Filed: Mar. 28, 1994

[30] Foreign Application Priority Data

Mar. 8, 1994 [IT] Italy ..... MI94A0422

[51] Int. Cl.[6] ..... E04H 9/02; E02D 27/34

[52] U.S. Cl. ..... 52/167.8; 52/167.1; 52/167.4

[58] Field of Search ..... 52/167 R, 167 RM, 52/167 RA, 167 E, 167 EA

[56] References Cited

FOREIGN PATENT DOCUMENTS 4-337139 11/1992 Japan ..... 52/167 R 5-71245 3/1993 Japan ..... 52/167 R 1328615A 8/1987 U.S.S.R. ..... 52/167 R

*Primary Examiner*—Carl D. Friedman

*Assistant Examiner*—W. Glenn Edwards

*Attorney, Agent, or Firm*—Bucknam and Archer

[57] ABSTRACT

A load dissipating and limiting device for application in anti-seismic works comprises at least an elongated primary member to be connected with its two end portions to two elements of a work subjected to a related displacement, the elongated primary member being adapted to be elastically-plastically deformed, a secondary member being moreover provided to be interposed between one of the two elements of the work and the primary member, the secondary member being adapted to absorb displacements having a value less than a preset value, of one of the two elements with respect to the other, without generating any plastic effects in the primary member.

4 Claims, 2 Drawing Sheets

LOAD DISSIPATING AND LIMITING DEVICE FOR APPLICATION IN CIVIL AND INDUSTRIAL WORKS HAVING A HIGH STRENGTH AGAINST SEISMIC EFFECTS

BACKGROUND OF THE INVENTION

The present invention relates to a load dissipating and limiting device for application in civil and industrial works having a high strength against seismic effects.

In the anti-seismic construction field, such as, for example, bridges, viaducts or buildings in general, there have been already used load dissipating and limiting devices, comprising specifically designed steel pegs which have elastic-plastic properties and which are usually interposed between the work or building proper and its supporting construction or foundation, so as to damp as far as possible stresses which, during a seismic event, are transmitted from the soil to the work.

However, it has been found that during the operation of these prior load dissipating and limiting devices, the elastic-plastic performance of the mentioned pegs is triggered not exclusively by seismic events but also by any mutual movements occurring between the two elements of the works which are connected to one another by the mentioned devices, such as, for example, under the effect of a different thermal expansion of the two elements of the works.

Actually, the mutual movements deriving from the thermal expansion generate an elastic-plastic deformation of the load dissipating devices, which is susceptible to limiting the deformation possibilities of said devices, in addition to greatly limiting the efficiency thereof in a case of a seismic event.

Moreover, since the mentioned thermal expansions can be considered as assimilable to reciprocating motions, even if of a very low speed, a reciprocating or alternating stress effect is generated which, involving the plastic deformation field of these devices, can spoil their satisfactory operation.

Moreover, in practically testing the above prior load dissipating devices, it has been found that the damping of the seismic wave is the greatest if the vibrating period of the work changes during the seismic vibration period.

SUMMARY OF THE INVENTION

Accordingly, the aim of the present invention is to overcome the above mentioned problems, by providing a load dissipating and limiting device adapted to damp the so-called service displacements, such as, for example, the thermal expansions, without reducing the efficiency thereof in absorbing displacements due to seismic effects.

Within the scope of the above mentioned aim, a main object of the present invention is to provide such a device adapted to allow an easy variation of the vibrating period of the work construction, simultaneously with the seismic effect dissipating operation.

Another object of the present invention is to provide such a load dissipating device which is adapted to resist against mutual displacements greater than those which can be handled by the conventional load dissipating devices.

A further object of the present invention is to provide such a load dissipating device which has a very reduced cost, is very simple from a mere construction standpoint and has furthermore a multi-directional operation.

According to one aspect of the present invention, the above mentioned aim and objects, as well as yet other objects, which will become more apparent hereinafter, are achieved by a load dissipating and limiting device specifically designed for making civil or industrial works having a high strength against seismic effects, wherein said device comprises at least a primary member of elongated shape including two longitudinal end portions adapted to be connected to two elements of a work being subjected to mutual movements, said elongated shape primary member being designed for resisting against elastic-plastic deformations, and a secondary member to be interposed between one of said two elements of said work and said primary member, said secondary member being adapted to absorb displacements having a value or a speed less than a preset value, of one of said two elements with respect to the other without generating plastic effects on said primary member.

BRIEF DESCRIPTION OF THE DRAWINGS

Further characteristics and advantages of the present invention will become more apparent hereinafter from the following detailed disclosure of two preferred, though not limitative, embodiments of a load dissipating and limiting device, according to the present invention, which are illustrated, by way of an indicative, but in the accompanying drawings, not limitative example, where.

DESCRIPTION OF THE PREFERRED EMBODIMENTS

Figure 1:
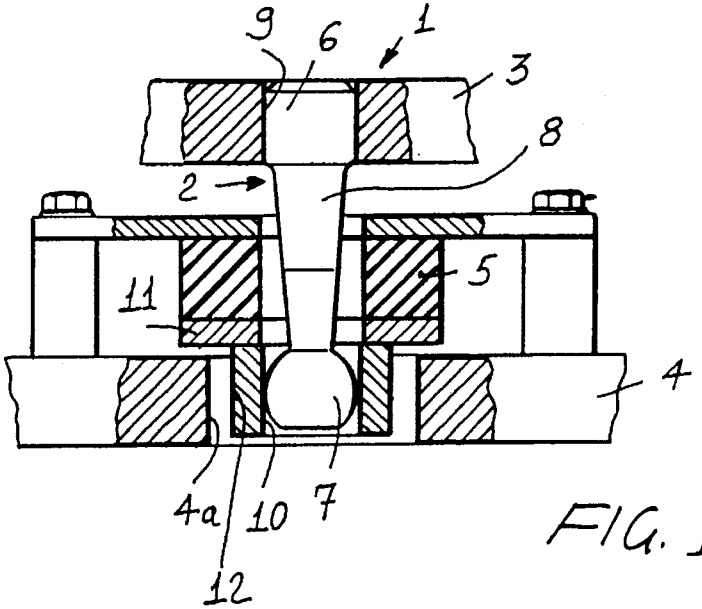
FIG. 1 schematically illustrates the load dissipating and limiting device according to the present invention, in a first embodiment thereof, as partially cross-sectioned according to a possible arrangement thereof.

With reference to FIG. 1, the load dissipating and limiting device, according to the present invention, which has been generally indicated at the reference number 1, comprises at least a primary member 2, having and elongated shape, which is preferably made of a high end elongation steel, and which has been specifically designed to be connected at its two longitudinal end portions, to two elements 3 and 4 of a generic work or building, which are subjected to mutual movements or displacements.

More specifically, the subject load dissipating and limiting device further comprises a secondary member 5, for interposition between one of the two elements of the work, in the case being shown the element 4, and the primary member and which is specifically designed for absorbing displacements which have a value or a speed less than a preset value, of the element 4, with respect to the other element 3 of the work, without generating any plastic effects on the primary member 2.

In particular, the primary member 2 comprises a peg, of a known type, having an elastic-plastic performance, which has an end portion 6 thereof of a substantially cylindric shape and the other end portion 7 thereof having substantially a ball shape.

The two end portions 6 and 7 are connected by a body 8 tapering from the end portion 6 toward the end portion 7, and the two opposite end portions 6 and 7 having diameters which are substantially mutually equal.

Preferably, the cylindric end portion 6 is provided for being introduced, either forcibly or with an axial sliding possibility, depending on requirements, inside a seat or recess 9 suitably defined in the inside of the element 3 of the work, whereas the other end portion 7 is provided for being received in a seat 10 defined on the other element 4 of the work.

Preferably th secondary member 5 is made of an elastomeric material body.

In particular, the secondary member 5 is advantageously arranged between one of the elements of the work, in the embodiment being shown the element 4 and a connection member 11, which is coupled to the primary member 2, means being moreover provided for limiting the displacement of the element 4 with respect to the connection element 11, due to a resilient yielding of the secondary member 5.

These displacement limiting means comprise an end of stroke or limit device, such as, for example, a surface 12 defined by said connecting element 11, which is turned, at a set distance, toward a surface 4*a* of the element 4.

Thus, a small displacement of the element 4 with respect to the element 3, such as, for example, a service or operation displacement deriving from a thermal expansion, will involve exclusively the secondary member 5, so as to resiliently deform the latter without involving in this deformation the primary member 2.

As the displacement value exceeds a preset amount, determined by the distances of the opposite shoulders of the limit device, the resilient performance or operation of the secondary member 5 ends, and is started the resilient-plastic operation of the primary member 2.

Figure 2:
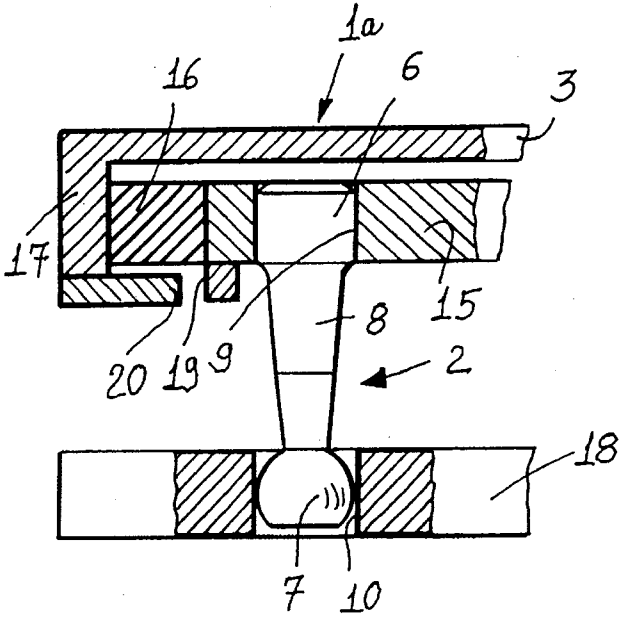
FIG. 2 schematically illustrates the load dissipating and limiting device according to the present invention, as partially cross-sectioned, in a further possible arrangement of the first embodiment thereof.

The load dissipating and limiting device, according to the present invention, in its first embodiment, but according to another arrangement different from that shown n FIG. 1, is illustrated in FIG. 2, where it has been indicated at the reference number 1*a*.

As shown in this Figure, the primary member 2, which is substantially made as shown in FIG. 1 and, which, accordingly, has been indicated by the same reference numbers, is connected, with its cylindric end portion 6, to a connecting or affixing member 15 which, in turn, is coupled, by means of a secondary member 16, to an element 17 of a work, whereas the other end portion 7 of the primary member 2 is coupled to another element 18 of that same work.

In this second arrangement too there are provided means for limiting the displacement of the element 17 of the work with respect to the affixing or connecting member 15, due to a resilient yielding of the secondary member 16.

This displacement limiting means are formed, also in this case, by a limit device including an abutment 19 rigid with the affixing or connecting member 15 and facing, at a preset distance, a surface 20 defined by the element 17.

Both in the arrangement shown in FIG. 1 and in that shown in FIG. 2, the secondary member 5, 16 which is arranged near and encompasses a length of one end portion of the primary member 2, can be directly vulcanized or cured on metal elements, rigid with the affixing member 15, defining one of the surfaces of the limit device.

Figure 3:
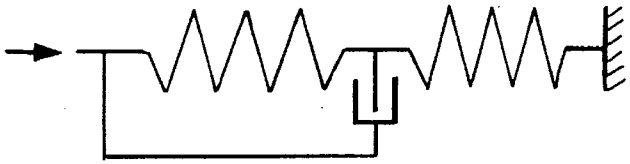
FIG. 3 illustrates a theoretical diagram of the load dissipating and limiting device, according to the present invention, shown in FIGS. 1 and 2.

The operating diagram of the load dissipating and limiting device, in its first embodiment, is shown in FIG. 3, where the primary member 2 has been schematically indicated by a spring and the secondary member 5, 16 has been schematically indicated by a second spring series-arranged with respect to the primary member.

FIG. 3 also schematically shows the limit device, by which the series operation of the secondary member 5, 16 and of the primary member is limited within the resilient range or field of the primary member 2.

Figure 4:
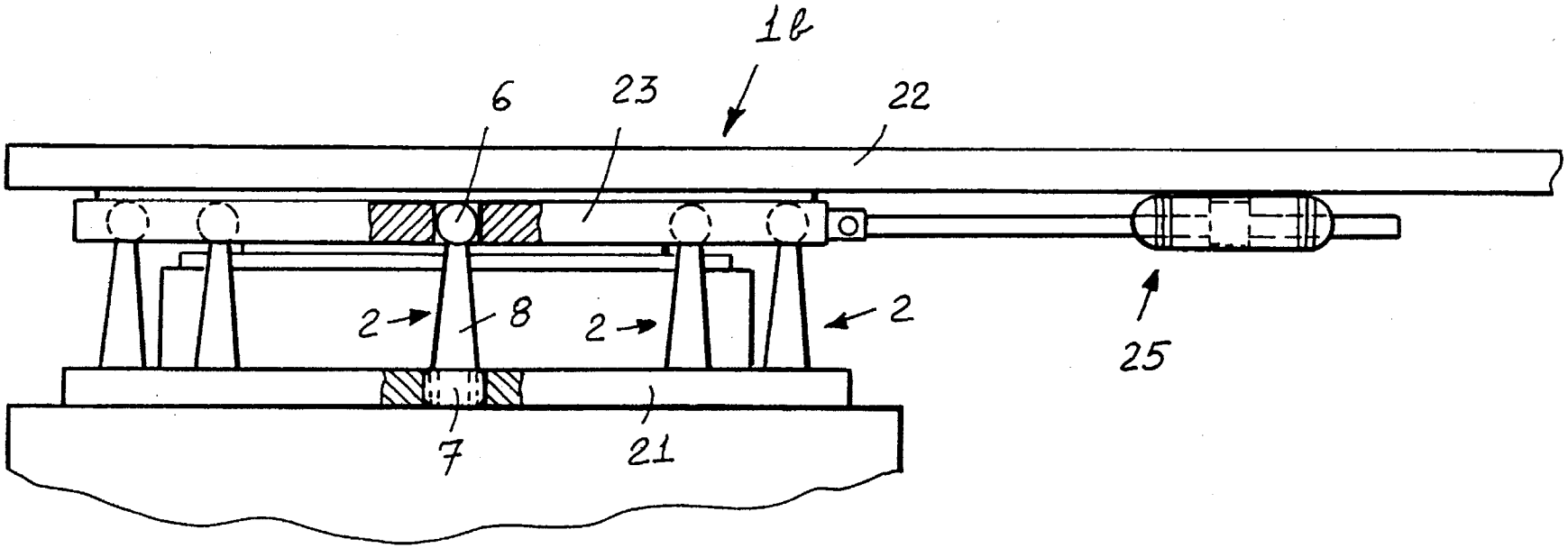
FIG. 4 is a schematic partially cross-sectioned view illustrating the load dissipating and limiting device according to the present invention in the second embodiment thereof.

FIG. 4 illustrates the second embodiment of the load dissipating and limiting device according to the present invention, herein indicated at the reference number 1*b*, and which comprises, as in the first embodiment, a primary member 2, substantially constructed as shown in the preceding figures and which, accordingly, is indicated by the same reference numbers.

In the second embodiment, the primary member 2 is arranged between an element 21 and an element 22 of the works, which elements can be displaced with respect to one another.

In particular, the primary member 2 is connected, with its cylindric end portion 6, to the element 21 and is connected, with its other end portion 7, to an affixing or connecting member 23, which is in turn connected to the element 22 through an oleo-dynamic device of the "schock-transmitter" type, indicated at the reference number 25, or through a device adapted to detach the element 22 from the affixing member 23 as the element 22 is displaced with respect to the member 23, which displacements will occur with a small speed, i.e. less than the reaction speed of this device and which, on the contrary, will cause the element 22 and member 23 to be rigidly connected as the mutual displacements have a speed greater than a preset limit speed.

Thus, the schock-transmitter type of oleo-dynamic device will not transmit to the element 22 those displacements having a very small speed, such as, for example, those deriving from the thermal expansions, and, on the contrary, it will transmit said displacements to the primary member or members 2, as said displacements will occur with a large speed, such as, for example, the displacements deriving from a seismic event.

Thus, the primary member 2 will operate very efficiently to dissipate and limit the load, owing to its elastic-plastic properties.

Thus, both in the first and second embodiments, the device according to the invention comprises a primary member 2 of elastic-plastic properties, and a secondary member 5, 16, 25 adapted to prevent the primary member from the being plastically deformed under mutual displacements of the two elements of the work, which are connected to one another by the primary member 2, because of displacements deriving from service conditions, such as, for example, the thermal expansions.

Owing to this fact, the load dissipating and limiting capabilities of the primary member 2 will be held unaltered under any conditions and, accordingly, they can be efficiently exploited for dissipating and limiting loads deriving from a seismic event.

Moreover, in the first embodiment, the series arrangement of a resiliently operating secondary member and an elastically-plastically operating primary member, will also provide a variation of the vibrating period of the work, simultaneously with the dissipation provided by the elastic-plastic operation primary member.

From the above disclosure and an examination of the drawing figures, it will be apparent that the device according to the present invention fully achieves its intended aim.

In particular, the fact is to be pointed out that a device has been provided which is specifically adapted to operate in a very reliable manner, since its operation is not negatively affected by the mentioned service displacements such those which are due to a thermal expansion.

The invention, as disclosed, is susceptible to several variations and modifications, all of which will come within the inventive idea scope.

Moreover, all of the details can be replaced by other technically equivalent elements.

In practicing the invention, the used materials, as well as the contingent size and shapes, can be any, depending on requirements.

We claim:

1. A load dissipating and limiting device specifically designed for making civil or industrial works having a high strength against seismic effects, comprising at least a primary member of elongated shape including two longitudinal end portions connected to two elements of a work being subjected to mutual movements, said elongated shape primary member being designed for resisting against elastic-plastic deformations, and a resilient secondary member interposed between one of said two elements of said work, said resilient secondary member being adapted to absorb displacements having a value less than a preset value, of one of said two elements with respect to the other without generating plastic effects on said primary member, limiting means being moreover provided for limiting a displacement of one of said two elements, wherein said resilient secondary member is arranged near and encompasses a length of one end portion of said primary member and wherein said limiting means comprise an abutment and facing, at a preset distance a surface defined by one of said two elements said preset distance being designed so that a displacement of a first value of said two elements deriving from a thermal expansion will resiliently deform only said resilient secondary element, whereas a displacement of a second value greater than said first value of said two elements will start a resilient-plastic operation of said primary member.

2. A device according to claim 1, wherein said secondary member comprises an elastomeric material body directly cured on metal elements defining at least one of the contact surfaces for said limiting means.

3. A load dissipating and limiting device specifically designed for making civil or industrial works having a high strength against seismic effects, comprising at least a primary member of elongated shape including two longitudinal end portions connected to two elements of a work being subjected to mutual movements, said elongated shape primary member being designed for resisting against elastic-plastic deformations, and a resilient secondary member interposed between one of said two elements of said work and an affixing member connected to said primary member, said resilient secondary member being adapted to absorb displacements having a value less than a preset value, of one of said two elements with respect to the other without generating plastic effects on said primary member, limiting means being moreover provided for limiting a displacement of one of said two elements with respect to said affixing member, wherein said resilient secondary member is arranged near and encompasses a length of one end portion of said primary member and wherein said limiting means comprise an abutment rigid with said affixing member and facing, at a preset distance a surface defined by one of said two elements said preset distance being designed so that a displacement of a first value of said two elements deriving from a thermal expansion will resiliently deform only said resilient secondary element, whereas a displacement of a second value greater than said first value of said two elements will start a resilient-plastic operation of said primary member.

4. A device according to claim 3, wherein said secondary member comprises an elastomeric material body directly cured on metal elements defining at least one of the contact surfaces for said limiting means.

* * * * *